US005341520A

United States Patent [19]

Lazar

[11] Patent Number: 5,341,520

[45] Date of Patent: Aug. 30, 1994

[54] VARIABLE TWIN CYCLE WATER METERING MACHINE

[76] Inventor: Vladimir F. Lazar, 2015 32d Ave., San Francisco, Calif. 94116-1124

[21] Appl. No.: 917,463

[22] Filed: Jul. 21, 1992

[51] Int. Cl.[5] ..... E03D 1/14

[52] U.S. Cl. ..... 4/325; 4/415; 4/324; 4/391

[58] Field of Search ..... 4/415, 324, 353, 366, 4/325; 137/39.5, 438, 441, 122

[56] References Cited

U.S. PATENT DOCUMENTS

| | | | |
|---|---|---|---|
| 2,183,677 | 9/1939 | Heath | 4/18 |
| 2,877,788 | 5/1956 | Clark | 137/122 |
| 4,134,165 | 1/1979 | Phripp et al. | 4/393 |
| 4,145,775 | 3/1979 | Butler | 4/415 |
| 4,391,003 | 7/1983 | Talerico et al. | 4/415 |
| 4,483,024 | 11/1984 | Troeh | 4/324 |
| 4,485,501 | 12/1984 | Kloner | 4/324 |
| 4,504,984 | 3/1985 | Burns | 4/326 |
| 4,651,359 | 5/1987 | Battle | 4/324 |
| 4,748,699 | 1/1988 | Stevens | 4/324 |
| 4,764,995 | 8/1988 | Harney | 4/325 |
| 4,811,432 | 3/1989 | Harris | 4/325 |
| 4,817,216 | 4/1989 | Auman | 4/325 |
| 4,825,478 | 5/1989 | Harris | 4/415 |
| 4,837,867 | 6/1989 | Miller | 4/324 |
| 4,864,665 | 9/1989 | Toltzman | 4/325 |
| 4,881,279 | 11/1989 | Harney | 4/324 |
| 4,941,214 | 7/1990 | Harris | 4/325 |
| 4,945,581 | 8/1990 | Harris | 4/325 |
| 4,980,932 | 1/1991 | Stemples | 4/415 |
| 5,020,167 | 6/1991 | Harris | 4/325 |
| 5,075,907 | 12/1991 | Harris | 4/325 |

*Primary Examiner*—Henry J. Recla
*Assistant Examiner*—Greg Vidovich
*Attorney, Agent, or Firm*—David Pressman

[57] ABSTRACT

A dual capacity toilet flusher for controlling the release of water from a storage tank (25) into a bowl (23) and the refilling of the storage tank and the bowl after a flush. For liquid waste, the user gently presses the flush lever (24), thus rotates an arm (11) to raise a guide (13) and the flap valve (19) and locks a detent (64) in the guide against a locking arm (56). The open flap valve lowers the water level (36) and a float (15) connected to a cam assembly (67). After about 3.8 liters of water has drained out, a cam (39A) on the cam assembly rotates a spring loaded rocker assembly (68) to release the locking arm to allow the guide and flap valve to fall to stop water outflow. A feed tube then refills the tank while a bleed tube refills the bowl through the overflow pipe (16). Valves on the feed and bleed tubes allow manual flow rate adjustments. For solid wastes, the user quickly presses the flush lever. It thereupon quickly raises and locks the guide higher in a second detent (73) against a roller (69) on the rocker assembly. After about 19 liters of water has drained out, the float causes a cam (39B) to rotate the rocker assembly to release the guide and allow the flap valve to fall to stop water outflow. The feed tube refills the tank while the bleed tube refills the bowl. A tube positioner (14) controlled by the float moves the bleed tube away from the overflow pipe as soon as the bowl is fully refilled to prevent overfill.

20 Claims, 8 Drawing Sheets

VARIABLE TWIN CYCLE WATER METERING MACHINE

BACKGROUND

1. Field of Invention

This invention relates generally to toilet flushers, specifically to an improved dual-mode, or dual-volume, water-conserving flushing mechanism.

2. Prior Art

Household tank toilets are flushed by opening a flap valve at the bottom of the water tank to release the stored water, usually 19 liters (5 gallons), into the toilet bowl. Household flush-valve toilets use a delay-closing valve and a high-capacity supply pipe to rapidly deliver a similar quantity of water into the bowl. In either case the water carries the waste matter over a weir and out of the bowl, through a bowl trap, and into the sewer pipe by gravity and siphonic action. The siphonic action, when combined with gravity, causes the water to empty very rapidly, thereby carrying away all of the waste matter in the bowl. Initiating the siphonic action requires sufficient starting amounts of water in the bowl and the water tank. If either the bowl or the tank contain insufficient amounts of water, the siphon effect cannot be achieved and the bowl will not flush properly, allowing some waste matter to be left in the bowl.

Water used in flushing toilets accounts for a significant portion of water usage in most households. As stated, a typical toilet uses about 19 liters per flush. Solid wastes require the full capacity of the tank or flush valve to be flushed away. But liquid waste can be flushed with as little as 3.8 liters (1 gallon) from the tank if the bowl contains a sufficient starting amount of water, which is about 5.7 liters (1.5 gallons). Therefore, many different "dual mode" flushing mechanisms, or flushers, have been designed to provide two selectable flushing capacities, one for each type of waste. These dual mode, or dual flush, toilets can potentially save significant amounts of water by minimizing the water used for flushing liquid wastes.

A toilet bowl needs to be fully refilled after a flush so that it will flush properly the next time. A conventional fill valve in the tank usually accomplishes this by diverting, or bleeding, a small amount of water into the bowl through an overflow pipe during the refilling of the water tank. The fill valve has a fixed bleed rate designed so that the bowl will be fully refilled in the time it takes to fully refill the tank. However, after a toilet is flushed with a small amount of water, or small flush, the tank is refilled too quickly to allow the bowl to be fully refilled. The insufficiently filled bowl will not flush the next time, but will instead be filled to capacity by the discharged water from the tank. An additional flush is then needed to clear the dirty bowl. As a result, water is wasted. Many dual mode flushers suffer from this fault, including those of U.S. Pat. Nos. 5,075,907 to Harris (1991), 4,881,279 to Harney (1989), 4,864,665 to Toltzman (1989), and 4,837,867 to Miller (1989).

The dual-mode flusher shown in U.S. Pat. No. 4,504,984 to Burns (1985) can achieve a complete flush after a small flush. It accomplishes this by using an inefficiently large amount of water, which is not user adjustable, for the small flush so as to leave a larger amount of water in the bowl after the flush. Combined with the relatively large amount of water released from the tank in the next small flush, a complete flush can be achieved. However, maximum possible water conservation cannot be achieved with this design. U.S. Pat. Nos. 4,748,699 to Stevens (1988) and 4,134,165 to Phripp et al. (1979) show flushers which allow the user to adjust the volume of the small flush. However, the volume of the small flush cannot be adjusted below a still relatively large amount if complete and reliable flushes are to be guaranteed.

In summary, existing dual mode flushers have no means to refill the toilet bowl fully after a small flush. Therefore, they either require an additional flush after each small flush to clear the bowl, or they sacrifice efficiency for reliability by using large amounts of water for the "small" flush to ensure complete flushes every time.

OBJECTS AND ADVANTAGES

Accordingly, several objects and advantages of the invention are to provide a flusher which conserves water, which can provide a full capacity flush for solid wastes and which can provide a small capacity flush of the most efficient volume for liquid wastes. Other objects and advantages are to provide a flusher which can provide two flushing modes which can be easily selected by the user, which refills the toilet bowl accurately after each flush regardless of the flushing mode, which can be easily adjusted to refill the toilet bowl to variable levels, which provide a flusher which flushing modes can each be easily adjusted to discharge variable amounts of water, which is entirely operated by water power and gravity, which can be easily installed in conventional flush tanks using a flapper valve by either a professional plumber or a novice do-it-yourselfer, which can be easily incorporated by manufacturers into new toilets as original equipment, which is durable and reliable, which is simple in construction, which is compatible with ultra-low-flush toilets, and which is economical to manufacture.

Further objects and advantages will become apparent from a study of the following description and the accompanying drawings.

SUMMARY

In accordance with the present invention a toilet flusher provides two independently adjustable volumes of flushing water from a conventional storage tank into a toilet bowl. A main body, which fits over the overflow pipe of the tank, houses a guide connected to the flap valve of the tank. Pressing the flush handle gently lifts the guide, and therefore the valve, to a first position whereby a first locking mechanism holds the guide by a first detent. After about 3.8 liters (1 gallon) of water has been released, such as when flushing liquid wastes, the float rotates a first cam, which rotates a rocker mechanism to rotate the locking mechanism to release the guide and the valve to stop the water outflow.

Pressing the flush handle firmly lifts the guide, and therefore the valve, to a second position whereby the rocker mechanism holds the guide by a second detent. After about 19 liters (5 gallons) of water has been released, such as when flushing solid wastes, the float rotates a second cam which in turn rotates the rocker mechanism to release the guide and the valve to stop the water outflow.

The preferred embodiment of the flusher, and the manner and process of making and using it will now be described by discussing the drawing figures seriatim.

DRAWING FIGURES

Figure 1:
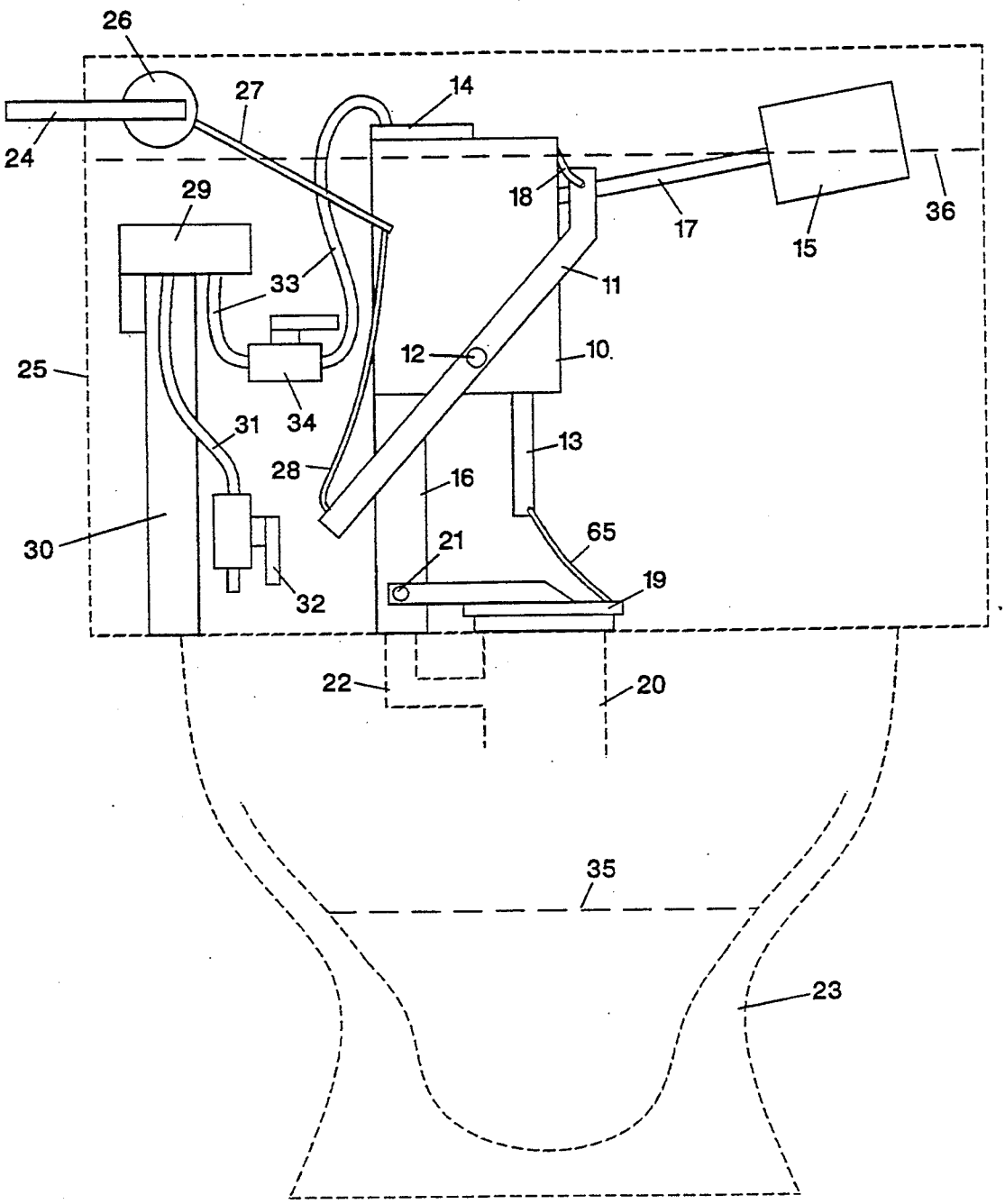
FIG. 1 is a front simplified view of a flusher, in accordance with the invention, fitted to a conventional toilet shown in a partial sectional view.

| Drawing Reference Numerals | | | |
|---|---|---|---|
| 10 | Body | 11 | Arm |
| 12 | Shaft | 13 | Guide |
| 14 | Tube Positioner | 15 | Float |
| 16 | Overflow Pipe | 17 | Float Arm |
| 18 | Cord | 19 | Flap Valve |
| 20 | Drain Pipe | 21 | Shaft |
| 22 | Connector Pipe | 23 | Toilet Bowl |
| 24 | Flush Lever | 25 | Water Tank |
| 26 | Pivot | 27 | Lever |
| 28 | Cord | 29 | Fill Valve |
| 30 | Fill Pipe | 31 | Feed Tube |
| 32 | Feed Valve | 33 | Bleed Tube |
| 34 | Bleed Valve | 35 | Bowl Water Level |
| 36 | Tank Water Level | 37 | Rod |
| 38 | Weight | 39A, 39B | Cams |
| 40 | Shaft | 41A, 41B | Discs |
| 42A, 42B | Notches | 43A, 43B | Triggers |
| 44 | Shaft | 45 | Roller |
| 46 | Shaft | 47 | Guard |
| 48 | Shaft | 49A, 49B | Prongs |
| 50 | Hole | 51 | Positioner Lever |
| 52 | Float Weight | 53A, 53B | Set Screws |
| 54 | Set Screw | 55A, 55B | Rockers |
| 56 | Locking Arm | 57 | Springs |
| 58 | Shaft | 59 | Roller |
| 60 | Pin | 61 | Anchors |
| 62A, 62B | Crests | 63 | Slot |
| 64 | Detent | 65 | Valve Cord |
| 66 | Roller | 67 | Cam Assembly |
| 68 | Trigger Assembly | 69 | Roller |
| 70 | Slot | 71 | Guide Pin |
| 72 | Rocker Pin | 73 | Detent |
| 74 | Sleeve | | |

DESCRIPTION—FIG. 1

In accordance with a preferred embodiment of the invention shown in the simplified view of FIG. 1, a flusher comprises a housing 10 mounted on the distal end of an existing and conventional overflow pipe 16 of water tank 25, an arm 11 hinged at shaft 12 located on the side and near the bottom of body 10, a guidepiece 13 extending downwardly from the bottom of body 10, a tube positioner 14, a float 15 at the distal end of a float arm 17 mounted on the top rear side of body 10, and a nylon cord 18 connecting the top end of arm 11 and the top end of guide 13 (not shown in FIG. 1 but shown in FIG. 3A) through the interior of body 10.

A flap valve 19 covering the top of drain pipe 20 is hinged at shaft 21 at the lower end of overflow pipe 16. A connector pipe 22 leads from the lower end of overflow pipe 16 to the side of drain pipe 20, which leads to a toilet bowl 23 with a water level 35, representing about 5.7 liters (1.5 gallons) in the bowl. A flush lever 24 mounted at the upper left corner of conventional water tank 25, which holds about 19 liters (5 gallons), is hinged at pivot 26. Alternatively the flusher can be advantageously be used with ultra-low-flush toilets where the bowl holds only about 1.9 liters (½ gallon). A lever 27 extends from pivot 26 at a slight downward angle. The distal end of lever 27 is connected to the lower end of arm 11 by a cord 28. Tank 25 has conventional and existing automatic fill valve 29 at the top end of a fill pipe 30 mounted at the left side of the tank. A feed tube 31 with feed valve 32 is connected to fill valve 29, while a bleed tube 33 with a bleed valve 34 spliced into the bleed tube is also connected to fill valve 29. The distal end of bleed tube 33 is connected to the moveable tube positioner 14. Tank 25 has a water level 36, representing a capacity of about 19 liters.

A conventional automatic fill valve 29 maintains water level 36 at any preselected level. Fill valve 29 may be of the pressure sensitive type. When water level 36 drops below the preselected level, such as after a flush, fill valve 29 will automatically release water through feed tube 31, feed valve 32, bleed tube 33 and bleed valve 34. Feed valve 32 empties water directly into tank 25 to refill the tank. Bleed tube 33 empties water either into overflow pipe 16 to refill bowl 23 or tank 25 to refill the tank, depending upon the position of tube positioner 14. If flap valve 19 is closed over drain pipe 20, water level 36 will rise until it reaches the preselected level, at which time fill valve 29 will shut off.

Feed valve 32 and bleed valve 34 are used to control the proportion of water sent into tank 25 and overflow pipe 16, respectively. For example, if a flush cycle uses 1.5 gallons from tank 25, while bowl 23 has a capacity of 1 gallon, then feed valve 32 and bleed valve 34 are adjusted such that feed valve 32 provides 1.5 times the flow rate of bleed valve 34 so as to refill tank 25 and bowl 23 proportionately.

Although feed valve 32 alone can control the flow ratio between feed tube 31 and bleed tube 33, the addition of bleed valve 34 enables the ratio to be fined tuned. This redundancy will be important in the event that feed valve 32 is unable to deliver the exact flow necessary to achieve the perfect fill level in bowl 23.

DESCRIPTION—FIG. 2A

Here the flusher is shown in a front perspective view. Body 10, generally rectangular in shape, has a flat front side 10' and a flat rear side 10''. A sleeve 74, integral to the left side of body 10, snugly fits over the distal end of overflow pipe 16. Lever 11 has a slight upward bend at shaft 12, and a sharper bend near its distal end such that the distal end is vertical. A short rod 37 extends orthoganally and inwardly from the top end of arm 11. A roller 45 on a shaft 46 is mounted near the top right corner of body 10, between front side 10' and rear side 10''. Cord 18 has a proximal end attached to rod 37, and loops up and around roller 45, and extends downwardly such that its distal end is attached to the top of guide 13 (not shown). A rectangular cord guard 47, attached between the top right corners of front side 10' and rear side 10'' and spaced slightly from roller 45, keeps cord 18 in place. The lower end of arm 11 has a weight 38 to which cord 28 is attached.

A cam 39A and 39B (not shown in FIG. 2A but shown in FIG. 8) are rotatably mounted on the front and rear sides, respectively, of body 10 at shaft 40, at about the same level as the top end of arm 11. Discs 41A and 41B (not shown) are concentrically mounted over cams 39A and 39B, respectively. Cams 39A and 39B (FIG. 8) are discs, each with two distinct semi-circular sections, one smaller than the other, such that the interface between the sections form notches 42A and 42A' on cam 39A, and notches 42B (FIG. 4B) and 42B' (FIG. 4B) on cam 39B. The cams are axially offset from each other such that notch 42B (FIG. 4B) is offset about 45 degrees clockwise from notch 42A. A trigger or cam follower 43A, which has a generally square distal end, is mounted on a shaft 44 and on the same plane as cam 39A, such that the right corner of the distal end of the trigger just touches the small arc of cam 39A. Notch 42A is axially offset from the right corner of the distal end of cam 39A about 40 degrees counterclockwise.

Tube positioner 14 is a horizontally positioned rectangular block with an integral disc at the right end. The disc portion of positioner 14 is hinged about a vertical shaft 48 mounted at the top portion of body 10. Positioner 14 has a prong 49A, which is on the left side of shaft 48, extending horizontally and rearwardly from the disc, while a similar prong 49B, which is on the right side of the shaft, extending similarly. Bleed tube 33 is connected to a through hole 50 at the distal end of positioner 14 such that the distal end of bleed tube 33 is positioned over the openings of sleeve 74 and overflow pipe 16. Positioner lever 51 extends upwardly from cam 39B (FIG. 4B) and parallel to rear side 10". Lever 51 is positioned slightly to the left of prong 49A.

Figures 4A, 4B:
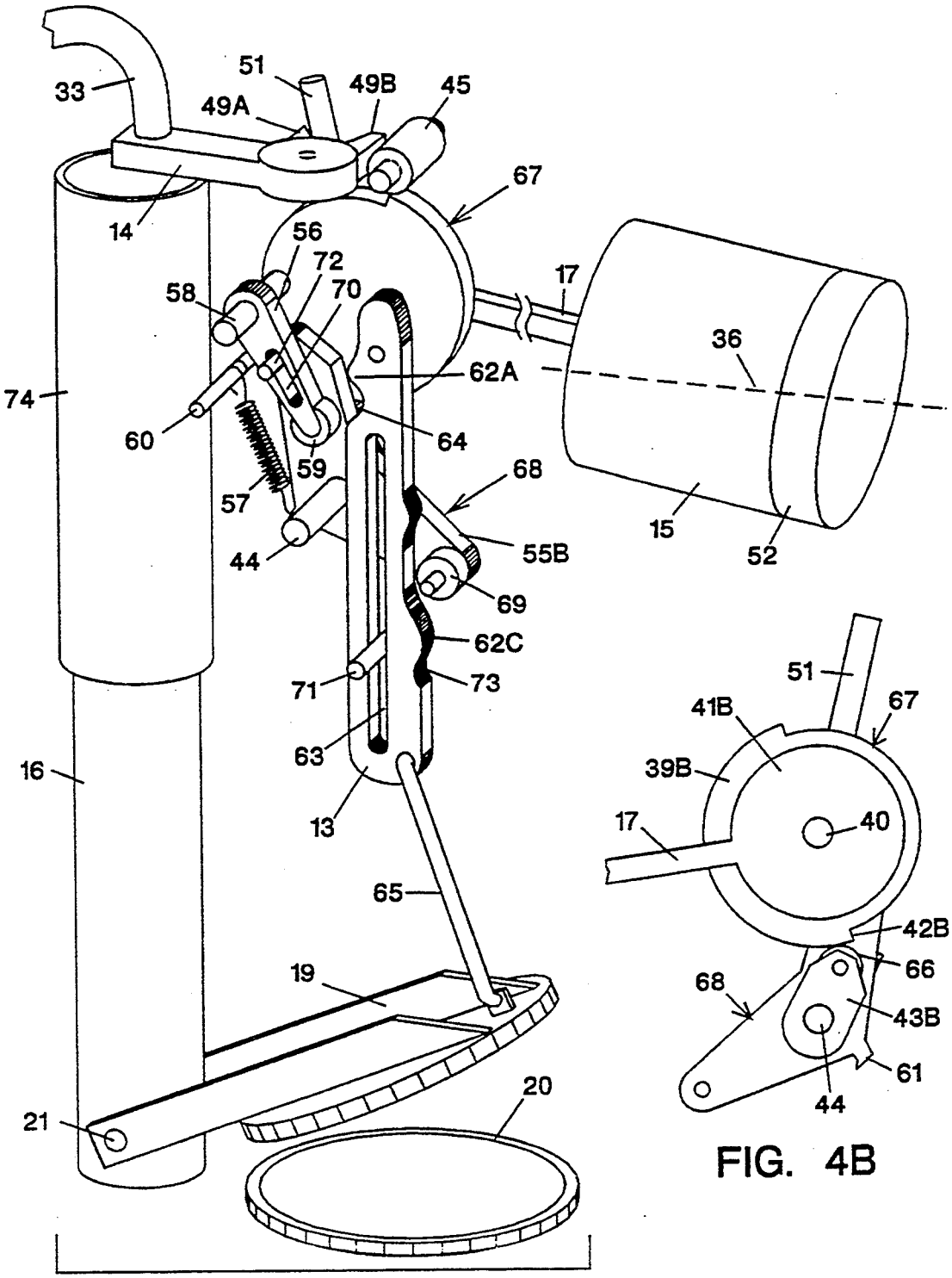
FIG. 4A is a front perspective view of the flusher of FIG. 3A, with the mechanisms moved into different positions.
FIG. 4B is a rear view of the cam assembly and the rocker assembly of FIG. 3B in different positions.

A float weight 52 is attached to float 15, which is attached to the distal end of float arm 17. The proximal end of float arm 17 is attached to disc 41B (FIG. 4B). Water tank 25 (FIG. 1) is fully refilled to water level 36, which lifts float 15 to its highest position. Flap valve 19, hinged at shaft 21 mounted on the lower end of overflow pipe 16, is connected to the lower end of guide 13 via a nylon valve cord 65. Flap valve 19 covers and seals the end of drain pipe 20. In the configuration shown, the flusher is ready to discharge water through drain pipe 20.

DESCRIPTION—FIG. 2B

Here in a top sectional view are shown cams 39A and 39B, discs 41A and 41B, and positioner lever 51, which collectively are known as cam assembly 67. Cams 39A and 39B both have recesses on their outer surfaces into which discs 41A and 41B, respectively, are partially inserted. Discs 41A and 41B are secured on shaft 40 by long set screws 53A and 53B, respectively, which are orthogonal to and tightened against shaft 40. Set screws 53A and 53B are embedded near the outer surfaces of the discs 41A and 41B. A short set screw 54 at the rim of cam 39A and tightened against disc 41A secures cam 39A on disc 41A. Positioner lever 51, threaded into the rim of cam 39B, is tightened against disc 41B to also act as a long set screw to secure cam 39B on disc 41B. Float lever 17 extends integrally from .the right edge of disc 41B.

Figures 2A, 2B:
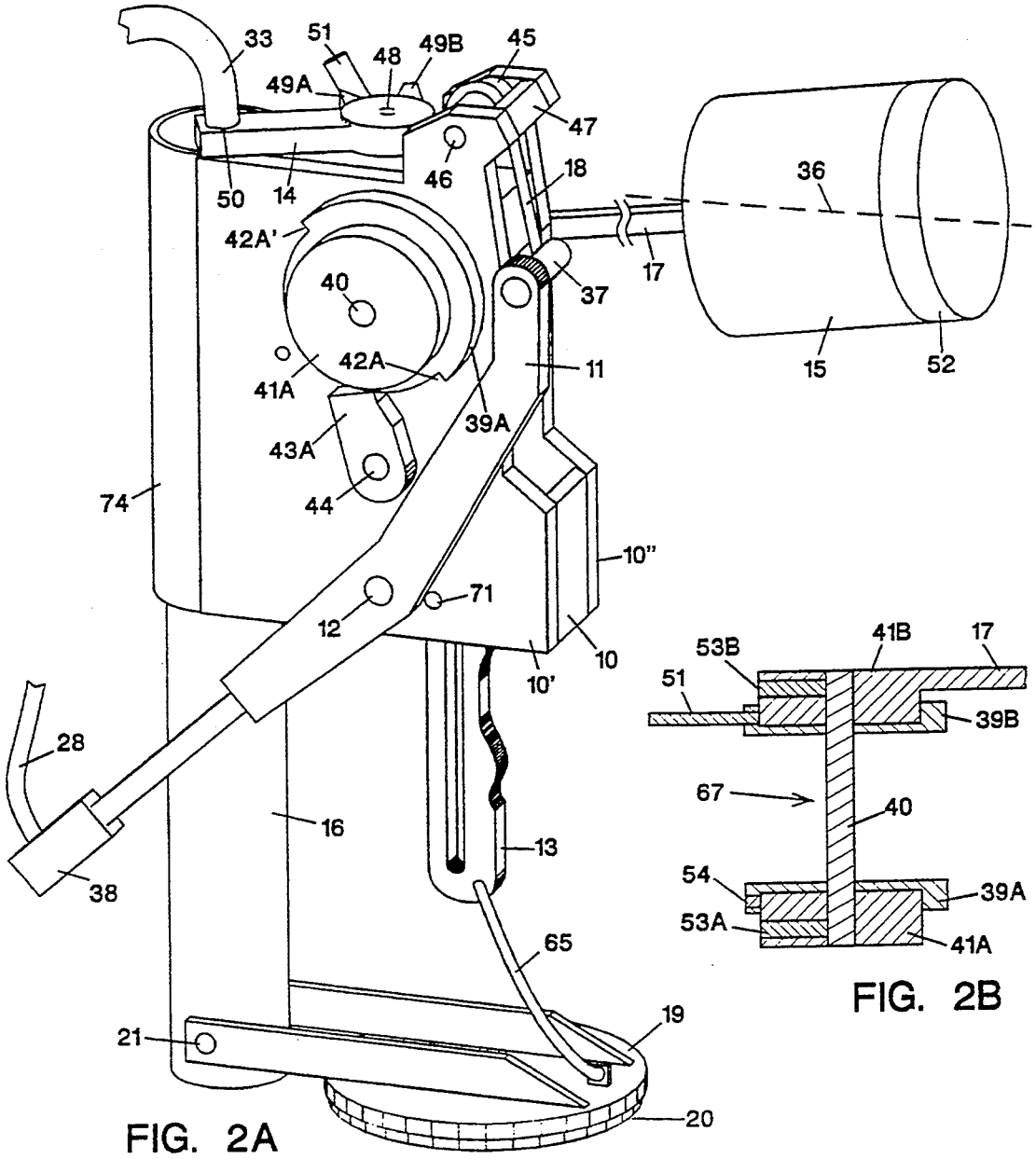
FIG. 2A is a front perspective view of the flusher of FIG. 1.
FIG. 2B is a top sectional view of the cam assembly of the flusher of FIG. 2A.

By loosening set screws 53A and 53B, individually rotating discs 41A and 41B, and retightening the set screws, the discs may be axially positioned about shaft 40 independently of one another, such that the two set of notches 42A and 42A', and 42B and 42B' may be offset from each other at any desired degree. Alternatively, by loosening set screw 54 and positioner lever 51, rotating cams 39A and 39B about discs 41A and 41B, respectively, and retightening set screw 54 and lever 51, the cams may also be positioned about the discs and the shaft independently of one another and of the discs. When all the set screws and positioner lever 51 are tightened, cams 39A and 39B, discs 41A and 41B, positioner lever 51, float lever 17, float 17, float weight 52, and shaft 40 all rotate together about the axis of shaft 40. In FIG. 2B, cam 39B and positioner lever 51 have been rotated such that positioner lever 51 is parallel to float lever 17 to permit all the parts of cam assembly 67 to be shown in a sectional view.

Referring to FIG. 2A, float 15 may be adjusted to float at any desired maximum water level 36 within tank 25 by loosening set screw 53B, rotating float 15, float arm 17, and disc 41B about shaft 40 until float 15 is at the desired position, then retightening set screw 53B. Because rotating disc 41B also rotates cam 39B and positioner lever 51, cam 39B and positioner lever 51 must be restored to their original positions by loosening lever 51, rotating cam 39B about disc 41B until positioner lever 51 is back at its initial position, then retightening lever 51 against disc 41B.

DESCRIPTION—FIG. 3A

Here the flusher is shown in a front perspective view with body 10, cord guard 47, cam 39A, disc 41A, and trigger 43A removed to clearly show the mechanisms within body 10.

The internal mechanisms generally comprise of identical rockers 55A and 55B, locking arm 56, guide 13, and extension springs 57. Rockers 55A and 55B, which are mounted on shaft 44, are spaced apart sufficiently to accommodate guide 13 between them. Rockers 55A and 55B are generally V-shaped, and are positioned such that the left side of the V's are vertical. Shaft 44, which is mounted through both sides of body 10 (not shown), goes through rockers 55A and 55B at about their center portions. The proximal end of locking arm 56 is pivoted about shaft 58, which is mounted through both sides of body 10 (not shown), but not through cam members 67, while the distal end of locking arm 56 has a roller 59. The mid section of locking arm 56 has a slot 70 (partially shown) slidably accommodating a pin (not shown) mounted between the upper ends of rockers 55A and 55B. The rockers have a roller 69 (partially shown) mounted between their lower ends. Springs 57 apply tension between a pin 60, which is mounted through both sides of body 10 (not shown), and anchors 61 (one shown) on the tips of the V's of rockers 55A and 55B, respectively. Springs 57 thus urge rockers 55A and 55B to rotate clockwise about shaft 44, while the rockers in turn urge locking arm 56 to rotate counterclockwise via the hidden pin (which will be shown in FIG. 4A) and slot 70. Guide 13 has a crest 62A on its upper left side, a crest 62B on its mid-right side, and a slot 63 running through most of its length.

Referring to FIG. 1, when a small capacity flush is desired, flush lever 24 is gently depressed, which causes lever 27 to rotate upwards about pivot 26. Lever 27 pulls cord 28 and thus the lower end of arm 11 upwards, which rotates arm 11 clockwise about shaft 12 and causing the top end of arm 11, rod 37, and the top of cord 18 to be moved downwardly, as shown in FIG. 3A.

Figures 3A, 3B:
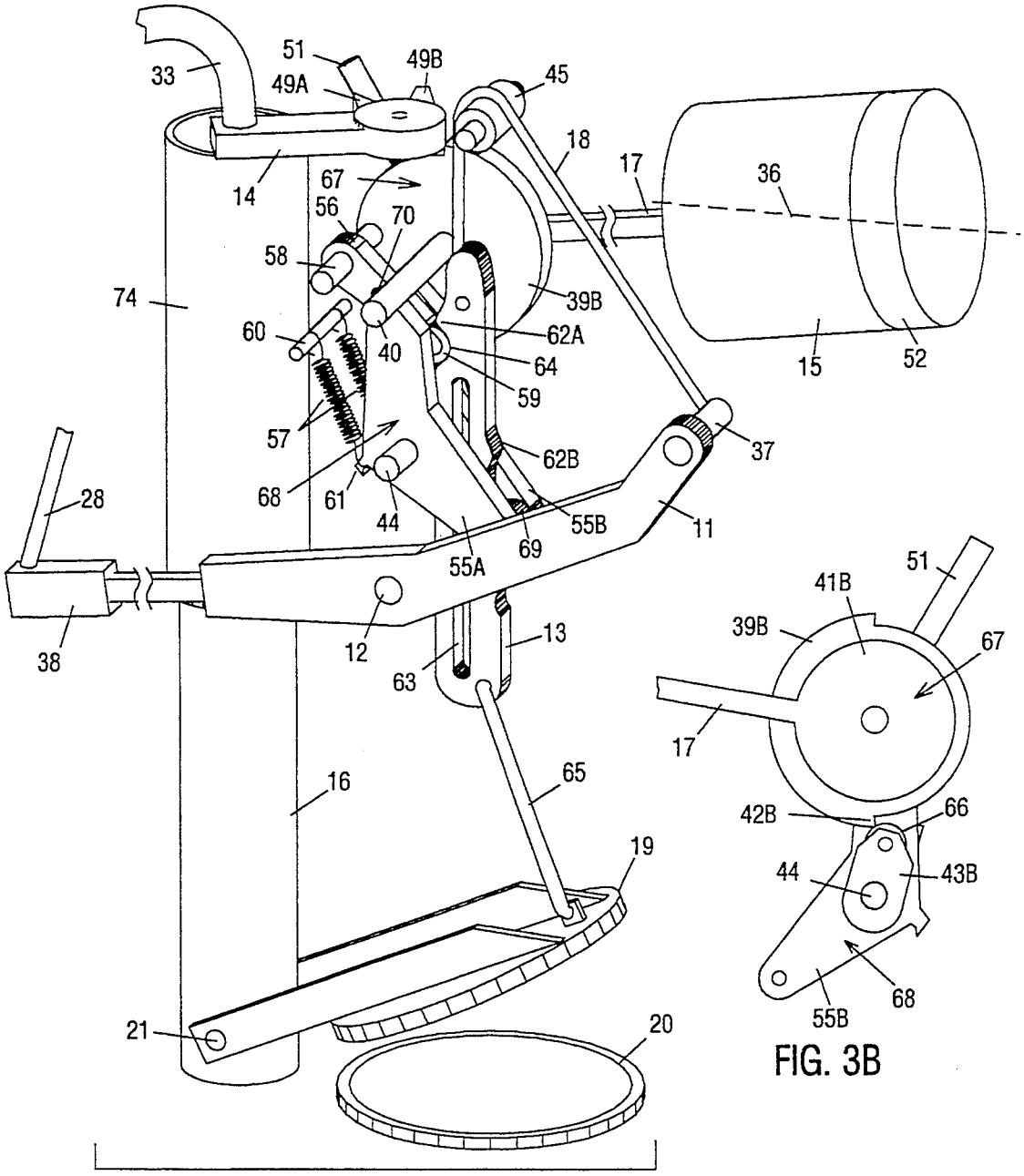
FIG. 3A is a front perspective view of the internal mechanisms of the flusher of FIG. 2A.
FIG. 3B is a rear view of the cam assembly and the rocker assembly of the flusher of FIG. 3A.

In FIG. 3A, arm 11 has rotated clockwise about 45 degrees and has pulled guide 13 upwards via cord 18. As guide 13 moves upwards from its initial position in FIGS. 1 and 2A, roller 59 on the distal end of locking arm 56 will ride up crest 62A and rotate locking arm 56 clockwise against the tension of springs 57 as transmitted by rockers 55A and 55B. When roller 59 passes the tip of crest 62A, arm 56 is urged by the same spring tension to rotate counterclockwise and place roller 59 into detent 64. Guide 13 is thus locked in position by roller 59 and detent 64. The upward movement of guide 13 has pulled flap valve 19 open via valve cord 65, which allows a relatively small amount of water to enter drain pipe 20 and into toilet bowl 23 to produce a small flushing action, suitable for liquid wastes (urine). Conventional tank 25, which has a large capacity, is completely filled when the small flush is initiated. Therefore, the water pressure at the opening of drain pipe 20 is great enough to force the water through drain pipe 20 at a high enough rate of flow to facilitate an effective and complete flush.

Tube positioner 14 positions the distal end of bleed tube 33 over the openings of sleeve 74 and overflow pipe 16.

DESCRIPTION—FIG. 3B

Here cam 39B and disc 41B are shown in a rear view at the beginning of the flush cycle, when float 15 and float arm 17 are at their highest positions. Notch 42B is at the bottom most position. Trigger 43B is attached to shaft 44 and has a roller 66 at its distal end. Roller 66 is positioned on the same plane as cam 39B, while the rim of the roller is slightly inside the larger arc of cam 39B. Roller 66 is positioned by trigger 43B slightly off to the right of notch 42B. Triggers 43A (not shown) and 43B, roller 66, rockers 55A (not shown) and 55B, and shaft 44 are collectively known as trigger assembly 68. Triggers 43 and rockers 55 are fixed about shaft 44 so that they all rotate as one.

DESCRIPTION—FIG. 4A and 4B

Here the flusher is shown with one of springs 57 and rocker 55A removed to more clearly show the relationship between locking arm 56, rocker 55B, and guide 13.

After the small capacity flush cycle is started, as shown in FIG. 3A, water will drain out of tank 25 (not shown) into drain pipe 20 to lower water level 36 to the position shown in FIG. 4A. Float 15, assisted by weight 52, will fall with water level 36, and rotate float arm 17 and cam assembly 67 (partly shown) clockwise. Referring back to FIG. 1, the fall of water level 36 will cause fill valve 29 to release water from fill pipe 30 into tank 25 through feed tube 31 and feed valve 32. Feed valve 32 can be used to manually adjust the rate at which water enters and refills tank 25 through feed tube 31. Fill valve 29 also releases water into overflow pipe 16 through bleed valve 34 and bleed tube 33, which is positioned over the opening of overflow pipe 16. Water will flow down overflow pipe 16, through connector pipe 22 and drain pipe 20, and into toilet bowl 23 to refill the bowl after the bowl is emptied by the siphon action. Bleed valve 34 allows the manual adjustment of the rate at which water is fed into overflow pipe 16 to refill bowl 23 to any desired level.

Referring to FIG. 4B, a rear view of cam assembly 67 and trigger assembly 68, the rotation of cam assembly 67 (counterclockwise in this view), and thus positioner lever 51, caused by the drop of float 15, will cause notch 42B to rotate counterclockwise against roller 66. Roller 66, and thus trigger assembly 68, are pushed by notch 42B to rotate clockwise until roller 66 rides up on the rim of cam 39B.

Referring back to FIG. 4A, the clockwise rotation of float 15, float arm 17, and cam assembly 67 will cause a counterclockwise rotation of trigger assembly 68 .against the tension of springs 57 (one not shown). Rocker pin 72, attached between the top ends of rockers 55A (not shown) and 55B and slidably fitted within slot 70 of locking arm 56, will push locking arm 56 and roller 59 clockwise. Roller 59 is thus moved away from detent 64 on guide 13 to allow the guide, valve cord 65, and flap valve 19 to fall. By the time flap valve 19 falls back over drain pipe 20, about one gallon of water has been released from tank 25 (not shown) into bowl 23 (not shown). A pin 71, affixed through body 10 (not shown), is slidably positioned within slot 63 of guide 13 such that the guide is constrained by pin 71 to vertical movements. The clockwise rotation of cam assembly 67 and thus positioner lever 51 cause the lever to push against prong 49B on tube positioner 14, which rotates the tube positioner clockwise. The distal end of tube positioner 14 is moved across the openings of sleeve 74 and overflow pipe 16, but will stop when the distal end of bleed tube 33 is still over pipe 16. Therefore, bleed tube 33 keeps feeding water into overflow pipe 16 to refill toilet bowl 23 (FIG. 1).

Referring to FIG. 3B, the capacity of the small flush may be adjusted by loosening positioner lever 51, repositioning cam 39B and positioner lever 51, then retightening lever 51 to lock cam 39B against disc 41B. A higher capacity small flush may be achieved by rotating cam 39B clockwise relative to disc 41B, such that notch 42B is farther to the left of roller 66. Therefore, water level 36 (not shown) and float 15 (not shown) will drop further before cam assembly 67 is rotated counterclockwise far enough to cause notch 42B to push against roller 66 and activate trigger assembly 68, which will in turn stop water release as described for FIG. 4A and 4B. On the other hand, a lower capacity small flush may be achieved by repositioning cam 39B counterclockwise such that notch 42B is closer to roller 66. The adjusting of positioner lever 51 is only for changing the capacity of the small flush; it is not intended for changing the timing of bleed tube 33 over overflow pipe 16.

DESCRIPTION—FIG. 5

Figure 5:
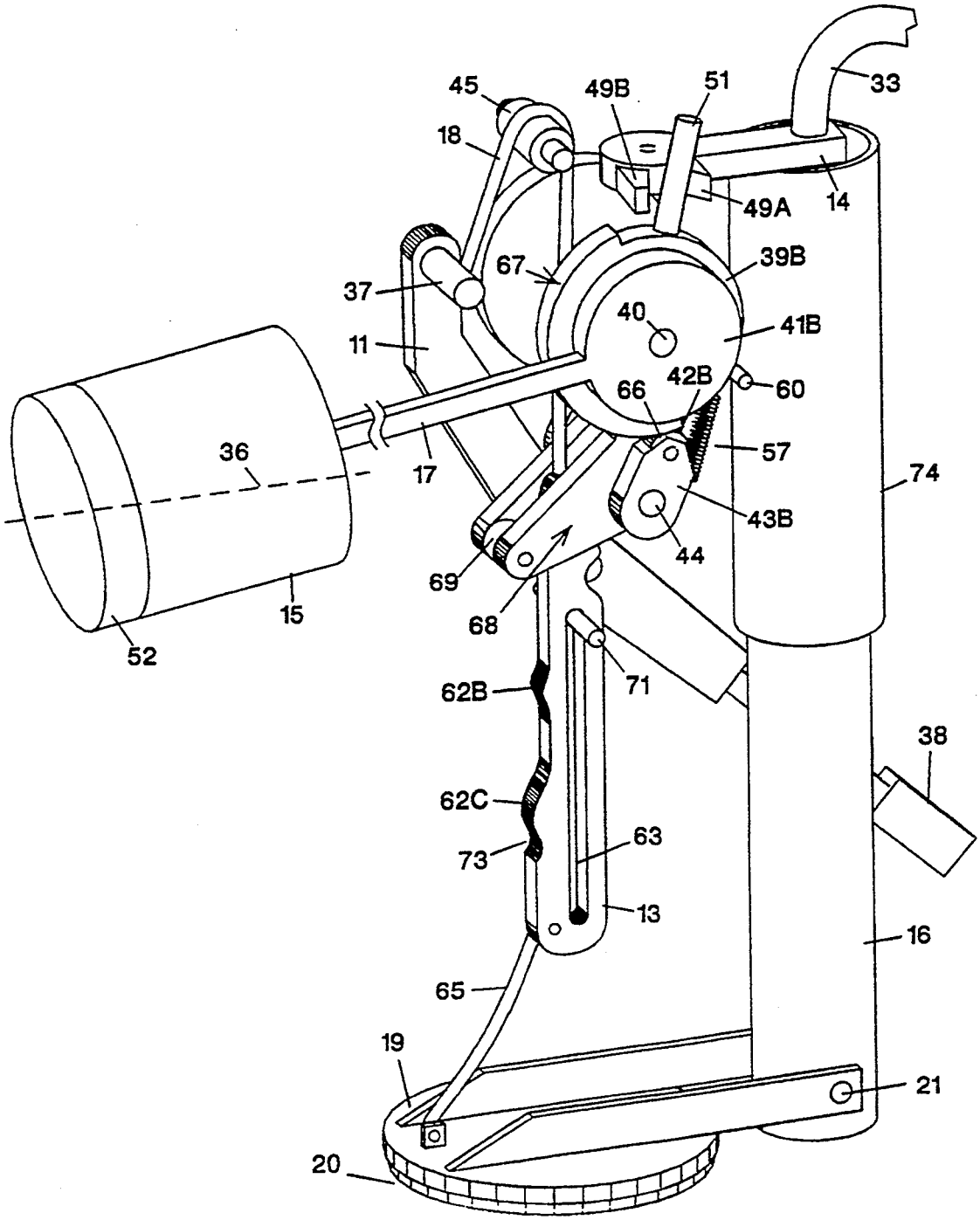
FIG. 5 is a rear perspective view of the flusher.

After locking arm 56 and roller 59 are released from detent 64, as shown in FIG. 4A, guide 13 is free to fall. FIG. 5 is a rear perspective view of the flusher which shows that guide 13, valve cord 65, and flap valve 19 have fallen such that the top end of slot 63 in guide 13 rests on pin 71. Flap valve 19 has sealed drain pipe 20 and stopped the release of water from tank 25 (not shown), such that the tank can be refilled by fill valve 29 (not shown). About 3.8 liters (1 gallon) of water is released from tank 25 into bowl 23 during the small flush. As the tank is refilled, water level 36 will rise to lift float 15 and float arm 17, and rotate cam assembly 67 clockwise. Positioner lever 51 on cam assembly 67 is also rotated clockwise, such that lever 51 pushes against prong 49A on tube positioner 14 to rotate the positioner and bleed tube 33 counterclockwise. When notch 42B on cam 39B has rotated past the left of roller 66 on trigger 43B, trigger assembly 68 will be urged by springs 57 to rotate counterclockwise into the position shown in FIG. 3B. Referring to FIG. 1, fill valve 29 will continue to refill tank 25 until the water level 36 has reached the original position shown, at which time fill valve 29 will automatically shut off. When fill valve 29 shuts off, bleed tube 33, which flow rate is controlled by bleed valve 34, will have refilled bowl 23 to its original level as shown in FIG. 1. When tank 25 is fully refilled, the flusher will be restored to the condition shown in FIG. 1 and 2A, ready to flush again.

DESCRIPTION—FIG. 6

Figure 6:
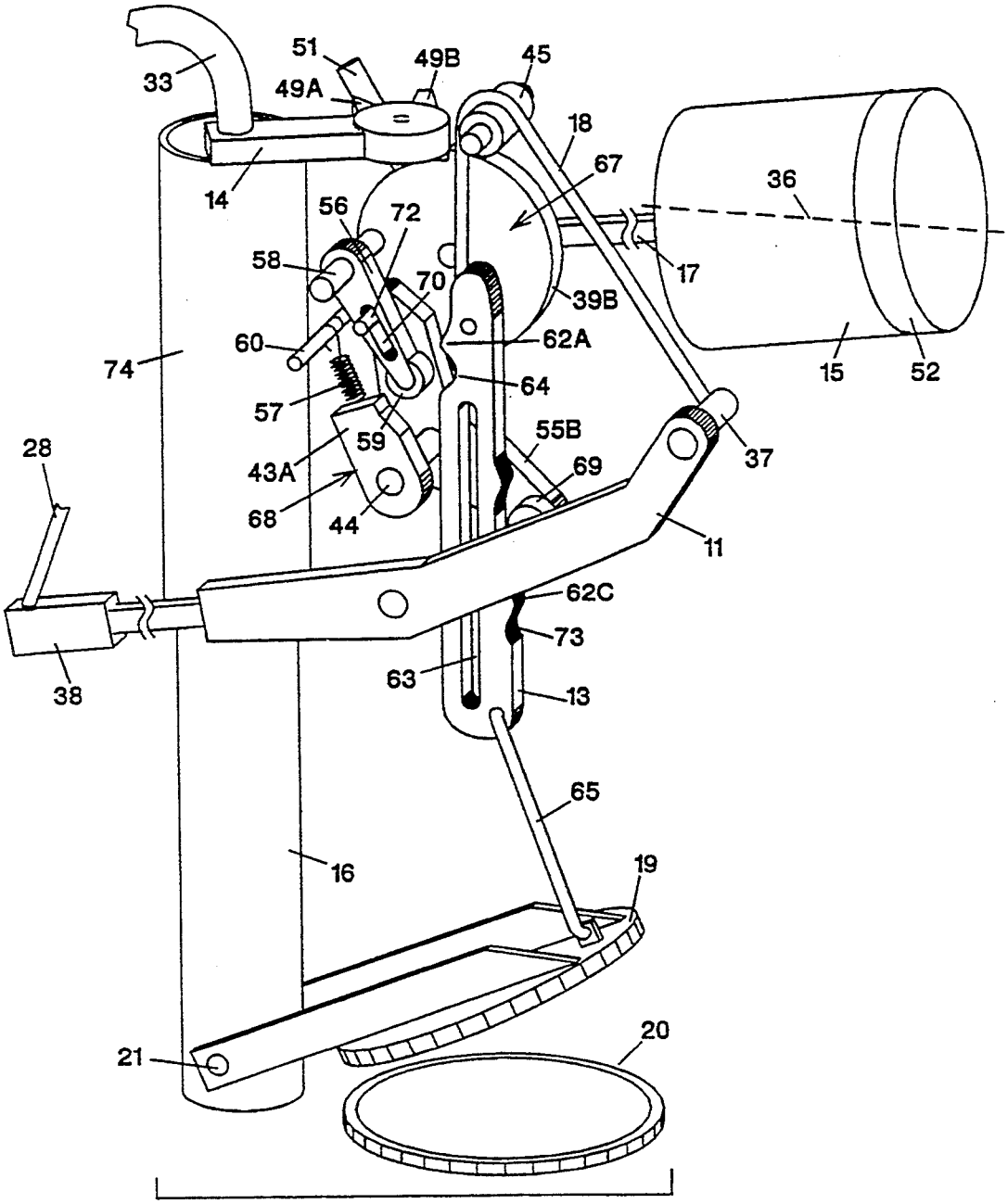
FIG. 6 is a front perspective view of the flusher.
Figure 7:
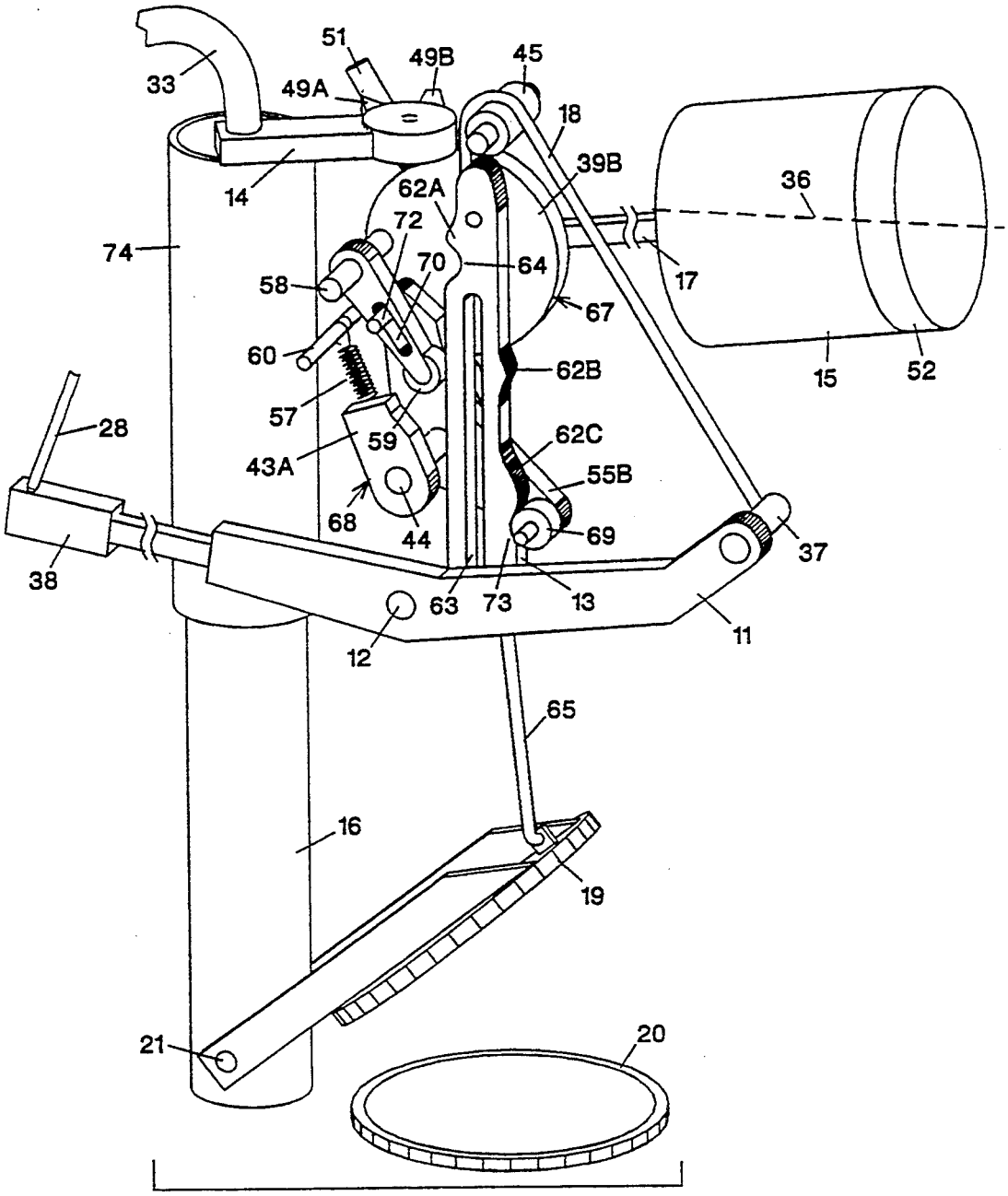
FIG. 7 is a front perspective view of the flusher.

Here the flusher is shown in a front perspective view with body 10, one of springs 57, and rocker 55A removed for clarity. Referring to FIG. 1, when a full flush is desired for flushing solid wastes (feces), flush lever 24 is pressed with a fast, snapping motion until the end of its travel such that lever 27 and cord 28 lifts the lower end of arm 11 quickly. Referring back to FIG. 6, the quick clockwise rotation of arm 11 will cause guide 13 to be lifted quickly via cord 18. Roller 59 on locking arm 56 will ride up crest 62A such that locking arm 56 will rotate clockwise. Slot 70 in locking arm 56 will push rocker pin 72 and thus trigger assembly 68 counterclockwise. The quick upward motion of guide 13 will allow detent 64 to travel past roller 59 without having the roller snap into the detent. The rise of guide 13 will lift flap valve 19 via valve cord 65 to unseal drain pipe 20 such that water is released into bowl 23 (not shown). Guide 13 will be lifted into its top most position as shown in FIG. 7.

A full capacity flush can also be initiated during the small capacity flush shown in FIG. 3A. Referring to FIG. 1, if after pressing flush lever 24 gently for a small flush, a full flush is then desired, then user continues to press flush lever 24 until the end of its travel will lift the distal end of lever 27 further and rotate arm 11 further clockwise. Referring back to FIG. 3A, arm 11 will pull guide 13 upwardly via cord 18, causing roller 59 to ride out of detent 64 and rotating locking arm slightly clockwise. The flusher will be in a condition such as that shown in FIG. 6, which is the beginning of the full capacity flush.

DESCRIPTION—FIG. 7

As guide 13 travels upwards after the full capacity flush is initiated, crest 62C will move past roller 69 on the right ends of rockers 55A and 55B. Crest 62C will push roller 69 and trigger assembly 68 slightly counterclockwise until the roller and the trigger assembly are urged by springs 57 to rotate clockwise such that roller 69 is locked into detent 73. Trigger assembly 68 is thus rotated into the position shown in FIG. 4B, such that roller 66 is riding on the rim of cam 39B and does not impede notch 42B on the cam from rotating to the right of roller 66. Water level 36 will drop as water empties into bowl 23 (not shown) through drain pipe 20, which allows float 15 and arm 17 to fall or rotate clockwise, assisted by weight 52. As cam 39B rotates, positioner lever 51 is caused to rotate to the right such that the lever will engage prong 49B on tube positioner 14 to rotate the tube positioner and tube 33 clockwise.

DESCRIPTION—FIG. 8

Figure 8:
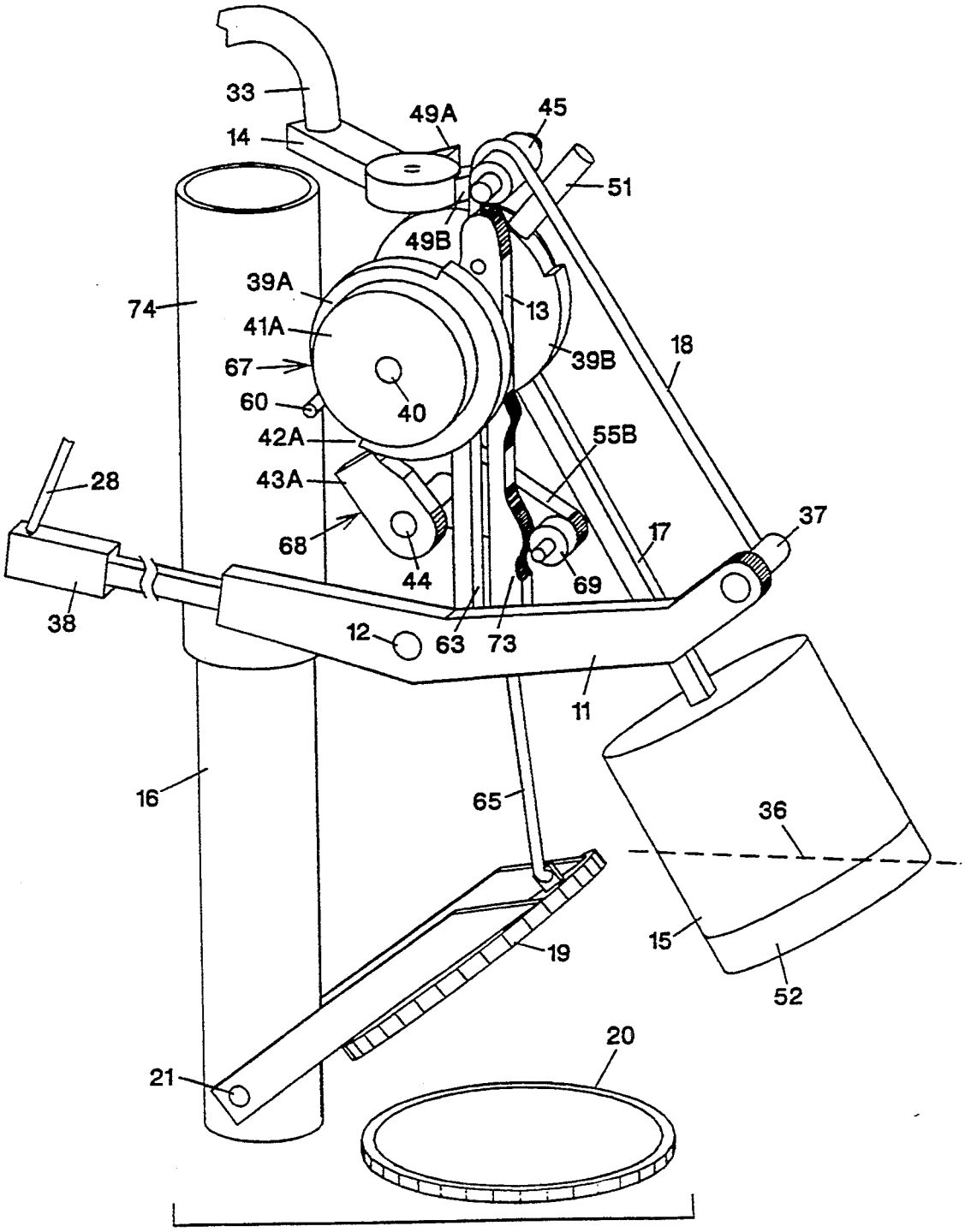
FIG. 8 is a front perspective view of the flusher.

When water level 36 drops to the level shown in FIG. 8, float 15 and cam assembly 67 are rotated approximately 90 degrees clockwise from their initial positions in FIG. 2A. Positioner lever 51 on cam 39B is rotated to its right most position such that prong 49B and thus tube positioner 14 are rotated to their most clockwise positions. The distal end of tube positioner 14 and the nozzle of tube 33 are positioned well away from the openings of sleeve 74 and overflow pipe 16. The nozzle of tube 33 will be moved away from pipe 16 well before positioner lever 51 and cam assembly 68 reach their final positions such that bleed tube 33 will stop feeding water into overflow pipe 16 and into bowl 23 (not shown). During the full-capacity flush, when the capacity of water released from tank 25 equals that of the small-capacity flush, the flusher will be in the condition shown in FIG. 4A. At that point, bleed tube 33 is carried to the edge of the opening of overflow pipe 16, such that as water level 36 continues to drop during the full capacity flush, bleed tube 33 will be carried beyond the edge of pipe 16 to stop feeding water into bowl 23. The rate of water flow through tube 33 and bleed valve 34 is adjusted such that tube 33 will fully refill bowl 23 through pipe 16 during the time tube 33 is over the opening of overflow pipe 16.

Tube positioner 14 will stop moving as soon as the distal end of prong 49B has rotated behind the plane of movement of positioner lever 51. When water level 36 has fallen to the level shown in FIG. 8, notch 42A on cam 39A will engage the distal end of trigger 43A to push the trigger towards the left, thus rotating trigger assembly 68 counterclockwise until trigger 43A rides on the rim of cam 39A. When trigger assembly 68 is rotated, roller 69 is moved away from detent 73, which allows guide 13, cord 65, and flap valve 19 to fall such that the valve will seal drain pipe 20 to stop the water outflow. As soon as water outflow is stopped, fill valve 29 is able to refill tank 25 through feed tube 31, feed valve 32, bleed tube 33, and bleed valve 34. Water level 36 will rise, lifting float 15 and weight 52 upwards such that lever 17 and cam assembly 67 are rotated counterclockwise until they reach their positions shown in shown in FIG. 1. Arm 11 is caused by weight 38 to rotate counterclockwise about shaft 12 until the arm is restored into its initial position in FIG. 1. When water level 36 has reached the original level, fill valve 29 will automatically shut off. The flusher is ready to be used again.

The capacity of the full flush may be adjusted by loosening set screw 54, as shown in FIG. 2B, repositioning cam 39A axially relative to disc 41A, then retightening set screw 54 to lock cam 39A against disc 41A. Referring to FIG. 2A, the capacity of the full flush may be increased by repositioning cam 39A counterclockwise such that notch 42A is farther to the right of the distal end of trigger 43A, such that water level 36 and float 15 will drop further before notch 42A will rotate trigger 43A to stop water outflow from tank 25 (not shown) as described above for FIG. 8. On the other hand, the capacity of the full flush may be decreased by repositioning cam 39A clockwise such that notch 42A is closer to trigger 43A, so that water level 36 and float 15 will have to drop less to cause notch 42A to rotate trigger 43A.

For maximum water conservation, the flusher can be adjusted to provide a small flush with as little as 1.9 liters (0.5 gallon), or a full flush with as little as 3.8 liters (1 gallon).

In a preferred embodiment of the flusher, all pans are made of plastic, such as ABS, except for float weight 52, and arm weight 38, which are preferably made of lead, while flap valve 19 is preferably made of rubber. Pins 60, pin 71, and springs 57 are preferably made of stainless steel, while cords 28 and 65 are preferably made of nylon.

SUMMARY, RAMIFICATIONS, AND SCOPE

Accordingly the reader will see that I have provided an improved toilet flusher which may provide small or full capacity flushes. For regular toilets, it can provide a full flush cycle of about 19 liters (5 gallons) for solid wastes, and a small flush cycle of about 3.8 liters (1 gallon) for liquid wastes, for ultra-low-flush tanks and bowls, etc. The flushing cycles, small or full, can be easily selected by the user by pressing the flush lever gently or quickly, respectively. It refills the bowl fully after each flush regardless of the flushing cycle. It can be adjusted to refill the bowl to different levels. The capacity of each flushing cycle can be adjusted to suit personal preferences and the flushing characteristics of the individual toilets in which the flusher is installed. It is entirely operated by water power and gravity. It can be easily installed in conventional flush tanks using a flapper valve by either a professional plumber or a novice, or it can be easily incorporated by manufacturers into new toilets as original equipment. It is also durable, reliable, simple in construction, and economical to manufacture.

While the above descriptions are specific, they should not be considered as limitations on the scope of the invention, but only as examples of the preferred embodiment. Many other ramifications and variations are possible within the teachings of the invention. For example, the components may be made of different materials. Roller 66 may be eliminated such that trigger 43B resembles trigger 43A. Rollers 59 and 69 may be replaced with fixed pieces integral to locking arm 56 and rockers 55A and 55B, respectively. Cams 39A and 39B, and discs 41A and 41B may be fixed with respective to each other. Float arm 17 may be made of a bendable metal such as brass so that arm 17 is bent up or down to position float 15 at any water level 36.

Thus the reader is requested to determine the scope of the invention by the appended claims and their legal equivalents, and not by the examples given.

I claim:

1. A selective full or partial flush mode water metering machine for controlling the release of water from a storage tank having an overflow pipe, a flap valve, and a normal quantity of water therein, into a bowl, comprising:

a body for fitting over said overflow pipe of said storage tank, guide means movably fitted to said body, said guide means adapted to be connected to said flap valve of said storage tank for controlling the opening and closing of said flap valve, said guide means being movable in a vertical direction for opening said flap valve to allow water to flow from said storage tank, said guide means having a first detent near a top portion thereof, and a second detent near a lower portion thereof, lifting means adapted to be connected to said tank and in connection with said guide means for moving said guide means in said vertical direction, first locking means in connection with said body for engaging said first detent of said guide means for locking said guide means in a first position during operation of a partial flush mode, rocker means pivoted about a horizontal axis and having a first portion slidably connected to said first locking means for moving said first locking means out from said first detent in said guide means, said rocker means having a second portion with a second locking means for engaging said second detent of said guide means for locking said guide means in a second position higher than said first position during operation of a full flush mode, float means in connection with said body floating on top of said water, when present, in said storage tank, first cam means connected to said float means and adapted to engage said rocker means and pivoted for rotation about a horizontal axis, said first cam means being arranged to rotate in response to said float means as said float means follows the rise and fall of said water, such that:

during said partial flush mode, when a first amount of water has been released from said storage tank such that said float means has fallen to a first level and caused said first cam means to rotate by a first amount, said first cam means will rotate said rocker means and said first portion of said rocker means, such that said first portion of said rocker means may move said first locking means out of said first detent of said guide means to allow said guide means to fall and said flap valve to close to stop water outflow from said storage tank, second cam means connected to said float means and adapted to engage said rocker means and pivoted for rotation about a horizontal axis, said second cam means being arranged to rotate in response to said float means as said float means follows the rise and fall of said water, such that:

during said full flush mode, when a second amount of water has been released from said storage tank such that said float means has fallen to a second level and caused said second cam means to rotate by a second amount, said second cam means will rotate said rocker means and said second locking means out of said second detent of said guide means to allow said guide means to fall and said flap valve to close to stop water outflow from said storage tank.

2. The water metering machine of claim 1, further including first and second trigger means attached to said rocker means for engaging said first cam means and said second cam means, respectively, such that said rocker means may be rotated by said first cam means and said second cam means.

3. The water metering machine of claim 1, further including:

a bleed tube adapted to be connected to a fill valve of said storage tank, positioning means in connection with said body for movably positioning said bleed tube such that:

(a) when said bleed tube is positioned over said overflow pipe, said bleed tube will release water into said overflow pipe for refilling said bowl after a flush, (b) when said bleed tube is positioned away from said overflow pipe, said bleed tube will release water into said storage tank to refill said tank after a flush.

4. The water metering machine of claim 1 wherein said positioning means comprises a bar with a proximal end pivoted about a vertical axis, and a distal end attached to a nozzle of said bleed tube, said bar being rotatable in a horizontal plane to position said nozzle either over or away from said overflow pipe.

5. The water metering machine of claim 1, further including a bleed valve attached to said bleed tube for controlling the water bleed rate into said bowl.

6. The water metering machine of claim 1, further including a feed tube adapted to be connected to said fill valve for feeding water into said storage tank, said feed tube having a feed valve for controlling the water feed rate.

7. A toilet flusher for a toilet having a storage tank and a toilet bowl, said toilet having a fill pipe for filling said storage tank and said toilet bowl with water, said fill pipe filling said toilet bowl through a bleed tube and an overflow pipe, comprising:

dual-mode flushing means adapted to be mounted within said tank for selectively providing either a small capacity flush or a large capacity flush of said water from said storage tank into said toilet bowl, valve means adapted to be attached to said fill pipe for controlling the refilling of said storage tank and said toilet bowl after each said flush, and said valve means including a bleed valve adapted to be attached to said bleed tube for controlling the water bleed rate into said toilet bowl positioning means in connection with said dual-mode flushing means for movably positioning said bleed tube so that:

(a) after initiation of said small capacity flush, said bleed tube will be positioned over said overflow pipe for delivering water into said overflow pipe for refilling said toilet bowl, said valve means being set for completing refilling of said storage tank and said toilet bowl generally simultaneously after said small capacity flush, and (b) after initiation of said large capacity flush, said bleed tube will be temporarily positioned away from said overflow pipe for delivering water into said storage tank, then positioned over said overflow pipe for delivering water into said overflow pipe for refilling said toilet bowl, so that said toilet bowl and said storage tank are fully refilled generally simultaneously.

8. The toilet flusher of claim 7 wherein said positioning means comprises a bar with a proximal end pivoted about a vertical axis, and a distal end attached to a nozzle of said bleed tube, said proximal end of said bar having means for engaging a proximal end of a float arm pivoted about a horizontal axis, so that when said float arm is rotated in a vertical plane, said bar will be rotated in a horizontal plane by said float arm to position said nozzle either over or away from said overflow pipe, the rotation of said bar being entirely derived from the rotation of said float arm.

9. The toilet flusher of claim 7 wherein said dual-mode flushing means comprises:

a housing;

guide means in connection with aid housing and adapted to be connected to a flap valve of said storage tank for controlling the opening and closing of said flap valve, said guide means being movable in a vertical direction for opening said flap valve to allow said water to flow from said storage tank, said guide means having a first detent near a top portion and a second detent near a lower portion, lifting means adapted to be connected to said tank and in connection with said guide means for moving said guide means in said vertical direction, first locking means in connection with said housing for engaging said first detent of said guide means for locking said guide means in a first position during operation of said small capacity flush, rocker means pivoted about a horizontal axis and having a first portion slidably connected to said first locking means for moving said first locking means out from said first detent in said guide means, said rocker means having a second portion with a second locking means for engaging said second detent of said guide means for locking said guide means in a second position higher than said first position during operation of said large capacity flush, float means in connection with said housing floating on top of a quantity of said water, when present, in said storage tank, first cam means connected to said float means and adapted to engage said rocker means and pivoted for rotation about a horizontal axis, said first cam means being arranged to rotate in response to said float means as said float means follows the rise and fall of said water, such that:

during said small capacity flush, when a first amount of water has been released from said storage tank such that said float means has fallen to a first level and caused said first cam means to rotate by a first amount, said first cam means will rotate said rocker means and said first portion of said rocker means, such that said first portion of said rocker means may move said first locking means out of said first detent of said guide means to allow said guide means to fall and said flap valve to close to stop water outflow from said storage tank, and second cam means connected to said float means and adapted to engage said rocker means and pivoted for rotation about a horizontal axis, said second cam means being arranged to rotate in response to said float means as said float means follows the rise and fall of said water, such that:

during said large capacity flush, when a second amount of water has been released from said storage tank such that said float means has fallen to a second level and caused said second cam means to rotate by a second amount, said second cam means will rotate said rocker means and said second locking means out of said second detent of said guide means to allow said guide means to fall and said flap valve to close to stop water outflow from said storage tank.

10. The toilet flusher of claim 7, further including a feed tube connected to said valve means for feeding water into said storage tank, said feed tube having a feed valve for controlling the water feed rate.

11. A selective full or partial flush mode toilet flusher for controlling the release of water from a storage tank through an overflow pipe into a toilet bowl, and controlling the refilling of said storage tank and said toilet bowl after a flush, comprising:

a housing adapted to be mounted within said tank;

guide means in connection with said housing and adapted to be connected to a flap valve of said storage tank for controlling the opening and closing of said flap valve, said guide means being movable in a vertical direction for opening said flap valve to allow water to flow from said storage tank, said guide means having a first detent near a top portion of said guide means and a second detent near a lower portion of said guide means, lifting means adapted to be connected to said tank and in connection with said guide means for moving said guide means in said vertical direction, first locking means in connection with said housing for engaging said first detent of said guide means for locking said guide means in a first position during operation of a partial flush mode, rocker means pivoted about a horizontal axis and having a first portion slidably connected to said first locking means for moving said first locking means out from said first detent in said guide means, said rocker means having a second portion with a second locking means for engaging said second detent of said guide means for locking said guide means in a second position higher than said first position during operation of a full flush mode, float means in connection with said housing floating on top of said water, when present, in said storage tank, first cam means connected to said float means and adapted to engage said rocker means and pivoted for rotation about a horizontal axis, said first cam means being arranged to rotate in response to said float means as said float means follows the rise and fall of said water, such that:

during said partial flush mode, when a first amount of water has been released from said storage tank such that said float means has fallen to a first level and caused said first cam means to rotate by a first amount, said first cam means will rotate said rocker means and said first portion of said rocker means, such that said first portion of said rocker means may move said first locking means out of said first detent of said guide means to allow said guide means to fall and said flap valve to close to stop water outflow from said storage tank, and second cam means connected to said float means and adapted to engage said rocker means and pivoted for rotation about a horizontal axis, said second cam means being arranged to rotate in response to said float means as said float means follows the rise and fall of said water, such that:

during said full flush mode, when a second amount of water has been released from said storage tank such that said float means has fallen to a second level and caused said second cam means to rotate by a second amount, said second cam means will rotate said rocker means and said second locking means out of said second detent of said guide means to allow said guide means to fall and said flap valve to close to stop water outflow from said storage tank, a bleed tube adapted to be connected to a fill valve of said storage tank, positioning means in connection with said housing for movably positioning said bleed tube such that:

(a) when said bleed tube is positioned over said overflow pipe, said bleed tube will release water into said overflow pipe to refill said bowl after a flush, and (b) when said bleed tube is positioned away from said overflow pipe, said bleed tube will release water into said storage tank to refill said tank after a flush.

12. The toilet flusher of claim 11 wherein said positioning means comprises a bar with a proximal end pivoted about a vertical axis, and a distal end attached to a nozzle of said bleed tube, said bar being rotatable in a horizontal plane to position said nozzle either over or away from said overflow pipe.

13. The toilet flusher of claim 11, further including a bleed valve attached to said bleed tube for controlling the water bleed rate into said toilet bowl.

14. The toilet flusher of claim 11, further including a feed tube adapted to be connected to said fill valve for feeding water into said storage tank, said feed tube having a feed valve for controlling the water feed rate.

15. The toilet flusher of claim 11, further including first and second trigger means attached to said rocker means for engaging said first cam means and said second cam means, respectively, such that said rocker means may be rotated by said first cam means and said second cam means.

16. A selective full or partial flush mode toilet flusher for a toilet storage tank having a fill valve, a feed tube extending from said fill valve for filling said storage tank, and a bleed tube extending from said fill valve for filling said toilet bowl, said fill valve normally supplying water to said feed tube at a substantially higher rate than said bleed tube, comprising:

a feed valve adapted to be connected to said feed tube for reducing the rate of water supplied into said storage tank, and increasing the rate of water supplied through said bleed tube into said toilet bowl, a bleed valve adapted to be connected to said bleed tube for fine tuning the rate of water supplied into said toilet bowl, so that said toilet bowl can be refilled precisely to a desired level, a body adapted to be fitted over an overflow pipe of said storage tank, guide means movably fitted to said body, said guide means adapted to be connected to a flap valve of said storage tank for controlling the opening and closing of said flap valve, said guide means being movable in a vertical direction for opening said flap valve to allow water to flow from said storage tank, said guide means having a first detent near a top portion and a second detent near a lower portion, lifting means adapted to be connected to said tank and in connection with said guide means for moving said guide means in said vertical direction, first locking means in connection with said body for engaging said first detent of said guide means for locking said guide means in a first position during operation of a partial flush mode, rocker means pivoted about a horizontal axis and having a first portion slidably connected to said first locking means for moving said first locking means out from said first detent in said guide means, said rocker means having a second portion with a second locking means for engaging said second detent of said guide means for locking said guide means in a second position higher than said first position during operation of a full flush mode, float means in connection with said body floating on top of water, when present, in said storage tank, first cam means connected to said float means and adapted to engage said rocker means and pivoted for rotation about a horizontal axis, said first cam means being arranged to rotate in response to said float means as said float means follows the rise and fall of said water, such that:

during said partial flush mode, when a first amount of water has been released from said storage tank such that said float means has fallen to a first level and caused said first cam means to rotate by a first amount, said first cam means will rotate said rocker means and said first portion of said rocker means, such that said first portion of said rocker means may move said first locking means out of said first detent of said guide means to allow said guide means to fall and said flap valve to close to stop water outflow from said storage tank, and second cam means connected to said float means and adapted to engage said rocker means and pivoted for rotation about a horizontal axis, said second cam means being arranged to rotate in response to said float means as said float means follows the rise and fall of said water, such that:

during said full flush mode, when a second amount of water has been released from said storage tank such that said float means has fallen to a second level and caused said second cam means to rotate by a second amount, said second cam means will rotate said rocker means and said second locking means out of said second detent of said guide means to allow said guide means to fall and said flap valve to close to stop water outflow from said storage tank.

17. A toilet flusher for a toilet storage tank having a fill valve, a feed tube extending from said fill valve for filling said storage tank, and a bleed tube extending from said fill valve for filling said toilet bowl, said fill valve normally supplying water to said feed tube at a substantially higher rate than said bleed tube, comprising:

a feed valve adapted to be connected to said feed tube for reducing the rate of water supplied into said storage tank, and increasing the rate of water supplied through said bleed tube into said toilet bowl, a bleed valve adapted to be connected to said bleed tube for fine tuning the rate of water supplied into said toilet bowl, so that said toilet bowl can be refilled precisely to a desired level, and positioning means adapted to be connected to said tank for movably positioning said bleed tube such that:

(a) when said bleed tube is positioned over an overflow pipe of said water storage tank, said bleed tube will release water into said overflow pipe for refilling said bowl after a flush, and (b) when said bleed tube is positioned away from said overflow pipe, said bleed tube will release water into said storage tank to refill said tank after a flush, said positioning means comprises a bar with a proximal end pivoted about a vertical axis, and a distal end attached to a nozzle of said bleed tube, said bar being rotatable in a horizontal plane to position said nozzle either over or away from said overflow pipe.

18. A selective full or partial flush mode toilet flusher for controlling the release of water from a storage tank into a toilet bowl, and for controlling the refilling of said storage tank and said toilet bowl after a flush, comprising:

a body adapted to be fitted over an overflow pipe of said storage tank, guide means movably fitted to said body, said guide means adapted to be connected to a flap valve of said storage tank for controlling the opening and closing of said flap valve, said guide means being movable in a vertical direction for opening said flap valve to water from said storage tank, said guide means having a first detent near a top portion of said guide means and a second detent near a lower portion of said guide means, lifting means adapted to be connected to said tank and in connection with said guide means for moving said guide means in said vertical direction, first locking means in connection with said body for engaging said first detent of said guide means for locking said guide means in a first position during operation of a partial flush mode, rocker means pivoted about a horizontal axis and having a first portion slidably connected to said first locking means for moving said first locking means out from said first detent in said guide means, said rocker means having a second portion with a second locking means for engaging said second detent of said guide means for locking said guide means in a second position higher than said first position during operation of a full flush mode, float means in connection with said body floating on top of water, when present, in said storage tank, first cam means connected to said float means and adapted to engage said rocker means and pivoted for rotation about a horizontal axis, said first cam means being arranged to rotate in response to said float means as said float means follows the rise and fall of said water, such that:

during said partial flush mode, when a first amount of water has been released from said storage tank such that said float means has fallen to a first level and caused said first cam means to rotate by a first amount, said first cam means will rotate said rocker means and said first portion of said rocker means, such that said first portion of said rocker means may move said first locking means out of said first detent of said guide means to allow said guide means to fall and said flap valve to close to stop water outflow from said storage tank, and second cam means connected to said float means and adapted to engage said rocker means and pivoted for rotation about a horizontal axis, said second cam means being arranged to rotate in response to said float means as said float means follows the rise and fall of said water, such that:

during said full flush mode, when a second amount of water has been released from said storage tank such that said float means has fallen to a second level and caused said second cam means to rotate by a second amount, said second cam means will rotate said rocker means and said second locking means out of said second detent of said guide means to allow said guide means to fall and said flap valve to close to stop water outflow from said storage tank.

a bleed tube adapted to be connected to a fill valve of said storage tank, said bleed tube having a bleed valve for controlling the water bleed rate, positioning means in connection with said body for movably positioning said bleed tube such that:

(a) when said bleed tube is positioned over said overflow pipe, said bleed tube will release water into said overflow pipe for refilling said bowl after a flush, and (b) when said bleed tube is positioned away from said overflow pipe, said bleed tube will release water into said storage tank to refill said tank after a flush, a feed tube adapted to be connected to said fill valve for feeding water from said fill valve into said storage tank for refilling said tank after a flush, said feed tube having a feed valve for controlling the water feed rate.

19. The toilet flusher of claim 18 wherein said positioning means comprises a bar with a proximal end pivoted about a vertical axis, and a distal end attached to a nozzle of said bleed tube, said bar being rotatable in a horizontal plane to position said nozzle either over or away from said overflow pipe.

20. The toilet flusher of claim 18, further including first and second trigger means attached to said rocker means for engaging said first cam means and said second cam means, respectively, such that said rocker means may be rotated by said first cam means and said second cam means.

* * * * *

UNITED STATES PATENT AND TRADEMARK OFFICE

CERTIFICATE OF CORRECTION

PATENT NO.: 5,341,520

DATED: Aug 30, 1994

PATENTEES: Lazar, V. F.

It is certified that error appears in the above-identified patent and that said Letters Patent is hereby corrected as shown below:

Col. 10, line 64, change "pans" to —parts —.

Signed and Sealed this

Eighth Day of November, 1994

*Attest:*

Bruce Lehman

BRUCE LEHMAN

*Attesting Officer*

*Commissioner of Patents and Trademarks*